US007717675B1

(12) United States Patent
Liang

(10) Patent No.: US 7,717,675 B1
(45) Date of Patent: May 18, 2010

(54) TURBINE AIRFOIL WITH A NEAR WALL MINI SERPENTINE COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 613 days.

(21) Appl. No.: 11/805,735

(22) Filed: May 24, 2007

(51) Int. Cl.
*F01D 5/08* (2006.01)

(52) U.S. Cl. ..... 416/95; 415/115; 416/97 R

(58) Field of Classification Search ..... 415/115; 416/95, 97 A, 97 R
See application file for complete search history.

(56) References Cited

U.S. PATENT DOCUMENTS 6,247,896 B1 6/2001 Auxier et al.
6,254,334 B1 * 7/2001 LaFleur ..... 415/115
6,280,140 B1 8/2001 Soechting et al.
6,379,118 B2 * 4/2002 Lutum et al. ..... 416/97 R
6,705,831 B2 3/2004 Draper
7,097,425 B2 * 8/2006 Cunha et al. ..... 416/97 R
7,137,776 B2 11/2006 Draper et al.
7,390,168 B2 * 6/2008 Liang ..... 416/97 R
7,537,431 B1 * 5/2009 Liang ..... 416/95

* cited by examiner

*Primary Examiner*—Igor Kershteyn
(74) *Attorney, Agent, or Firm*—John Ryznic

(57) ABSTRACT

A stator vane for use in a gas turbine engine, the vane having a plurality of near wall mini serpentine flow cooling modules arranged in an array on the airfoil walls. Each module includes a series of multiple pass serpentine flow cooling channels extending in the airfoil chordwise direction. Each module is connected by a cooling air feed hole to a cooling air supply cavity and a cooling air discharge hole connected to a cooling air discharge cavity, where both cavities are formed between the airfoil walls. Each series of multiple pass serpentine cooling channels is connected together by a spanwise channel. The spanwise channels can include a row of film cooling holes to discharge film cooling air onto the airfoil external surface. The discharge cavity can also include film cooling holes to discharge cooling air from the cavity onto the airfoil external surface.

17 Claims, 4 Drawing Sheets

TURBINE AIRFOIL WITH A NEAR WALL MINI SERPENTINE COOLING CIRCUIT

BACKGROUND OF THE INVENTION

1. Field of the Invention

The present invention relates generally to fluid reaction surfaces, and more specifically to a turbine blade with a cooling circuit.

2. Description of the Related Art Including Information Disclosed Under 37 CFR 1.97 and 1.98

In a gas turbine engine, especially in an industrial gas turbine engine, a turbine section includes multiple stages of stator or guide vanes and rotor blades to extract mechanical energy from a hot gas flow passing through the turbine. Increasing the turbine inlet temperature can increase the turbine efficiency, and therefore the engine efficiency. However, the maximum turbine inlet temperature is limited to the material characteristics of the turbine airfoils, especially the first stage guide vanes and rotor blades, since these airfoils are exposed to the highest temperature.

In order to allow for a higher gas flow temperature, the turbine airfoils include complex internal cooling circuits to provide the maximum amount of cooling for the airfoil while making use of the minimum amount of cooling air in order to maximize the efficiency of the turbine and therefore the engine. In a prior art turbine blade with near wall cooling, the airfoil main body includes radial flow channel plus re-supply holes in conjunction with film discharge cooling holes from the near wall channel. In this prior art airfoil, spanwise (the direction from root to tip) and chord wise (the direction from leading edge to trailing edge) cooling flow control due to airfoil external hot gas temperature and pressure variation is difficult to achieve. In addition, a single radial channel flow is not the best method of utilizing cooling air since it results in low convective cooling.

It is therefore an object of the present invention to provide for a turbine airfoil with a cooling circuit that will reduce the main body metal temperature and therefore reduce the cooling flow requirement and improve the turbine efficiency.

BRIEF SUMMARY OF THE INVENTION

A turbine blade with a near wall mini serpentine flow cooling circuit for the airfoil main body is used to reduce the airfoil main body metal temperature. The mini serpentine cooling circuit is constructed of a plurality of small module formations of serpentine cooling passages arranged along the pressure and suction side walls in an array from the leading edge to the trailing edge. Each module can have a triple 3-pass near wall serpentine flow circuit with a feed hole on the forward end and a collection cavity cooling air return hole on the aft end of the circuit. In an alternate embodiment, a row of multi-film cooling holes can be used in the passage connecting adjacent serpentine passages within each module. Each individual module can be designed based on the airfoil gas side pressure distribution in both the chord wise and the spanwise directions. Also, each individual module can be designed based on the airfoil local external heat load to achieve a desired local metal temperature.

DETAILED DESCRIPTION OF THE INVENTION

Figure 1:
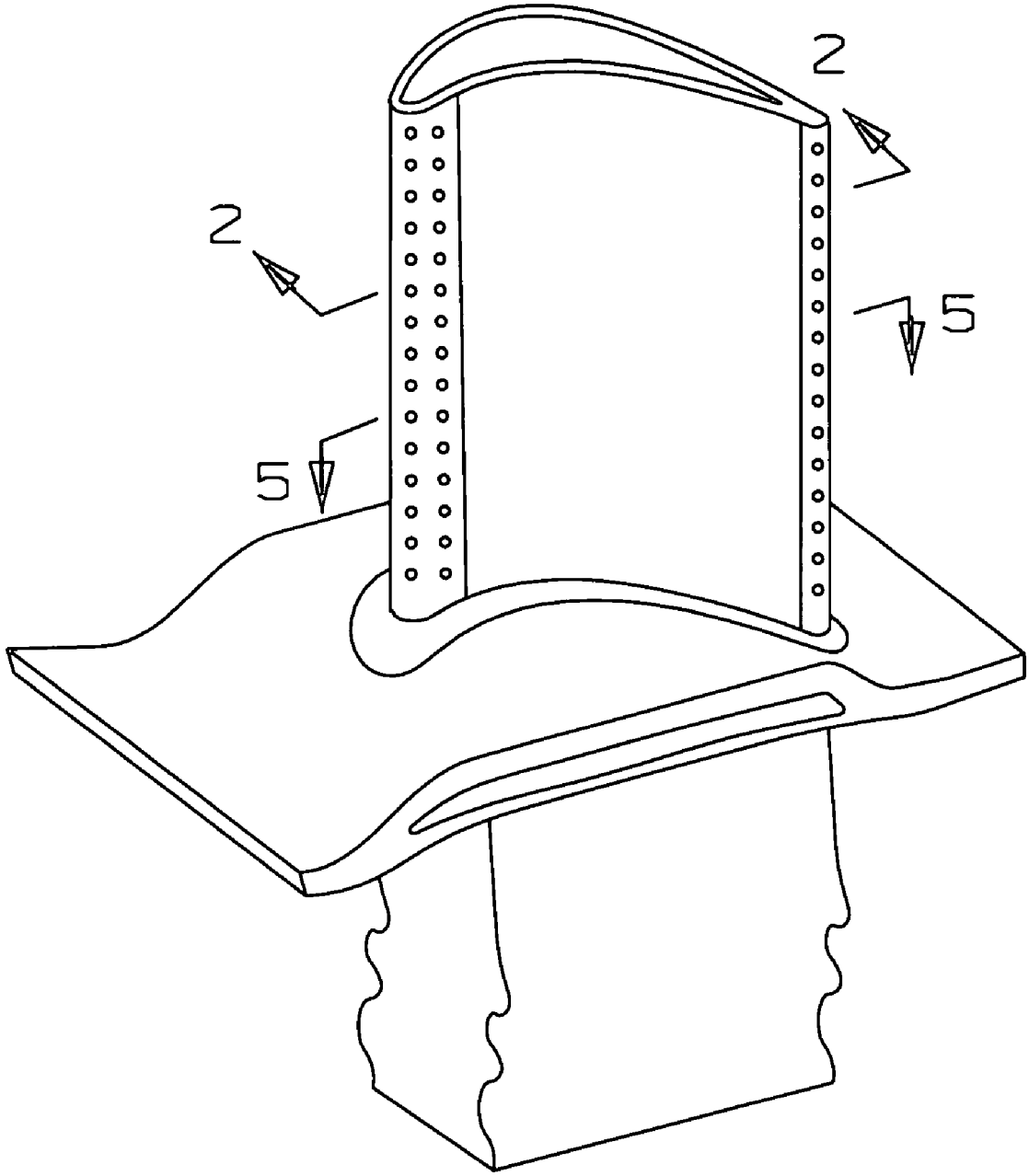
FIG. 1 shows a schematic view of a turbine blade with the near wall mini serpentine cooling modules of the present invention.

The present invention is a turbine blade used in an industrial gas turbine engine with a near wall mini serpentine flow cooling circuit arranged in modules along the airfoil walls to reduce the main body metal temperature. FIG. 1 shows the turbine blade of the present invention. However, the cooling circuits of the present invention can also be used in an aero gas turbine engine, or in stator vanes of both an industrial and an aero gas turbine engine. FIG. 1 shows the turbine blade with a pressure side airfoil wall with a plurality of the near wall mini serpentine cooling modules arranged extending from the blade platform to the tip, and from the leading edge region to the trailing edge region.

Figure 2:
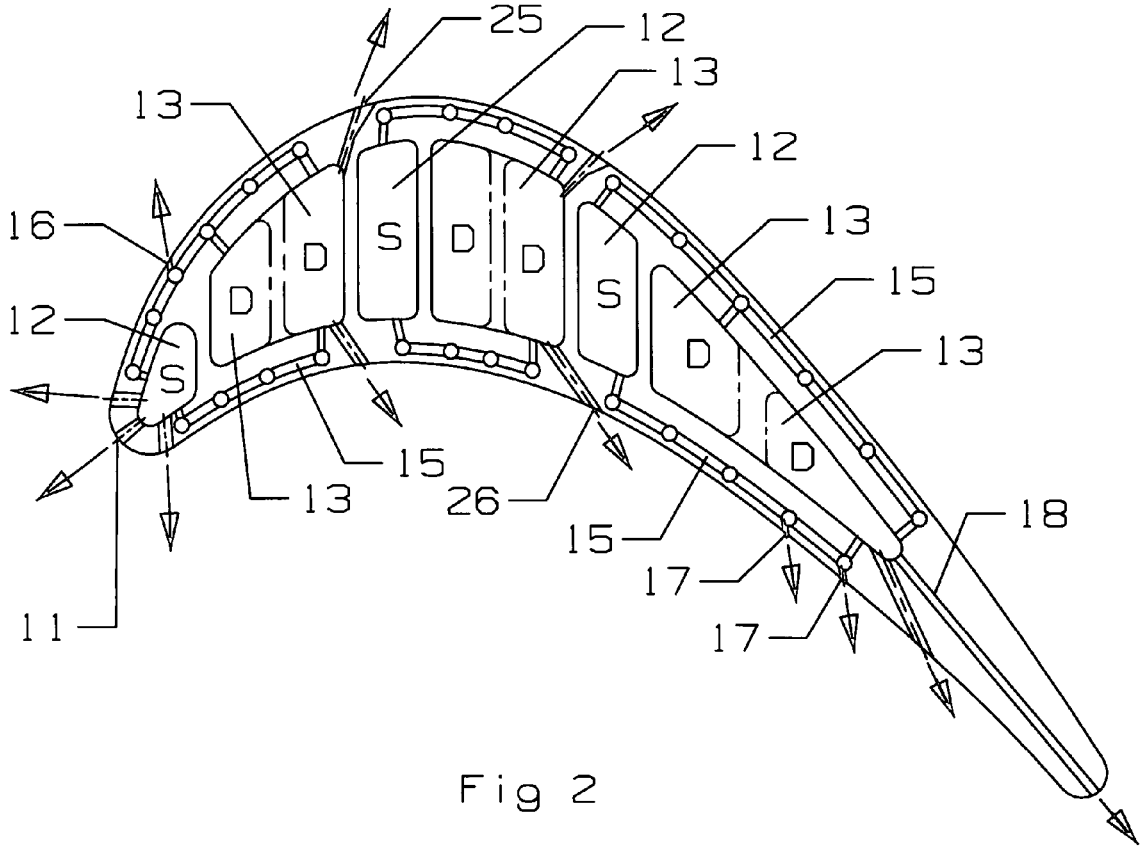
FIG. 2 shows a cross section top view of the near wall mini serpentine cooling circuit of the FIG. 1 turbine blade.

FIG. 2 shows a cross section view of the turbine blade of FIG. 1 with a leading edge having a showerhead arrangement of film cooling holes 11 connected to a leading edge cooling supply cavity 12. Located aft of the cooling supply cavity 12 is a number of cooling air discharge cavities 13 each separated by a rib. In the embodiment shown in FIG. 2, three cooling supply cavities 12 each with two cooling discharge cavities are arranged in the chord wise direction and extend from the leading edge to the trailing edge region of the airfoil. A near wall mini serpentine flow cooling channel 15 is located on both sides of the airfoil and between the supply cavity 12 and the aft most discharge cavity 13 as seen in FIG. 2. Cooling holes connect the mini serpentine channels 15 to the supply cavity 12 and each of the discharge cavities 13. The aft most discharge cavity is connected to a film cooling hole on one or both sides of the airfoil to discharge cooling air to the airfoil external surface. Suction side film cooling holes 25 and pressure side film cooling holes 26 are shown in FIG. 2. The aft most cooling discharge cavity 13 is connected to a trailing edge cooling slot 18 to discharge cooling air out the trailing edge of the airfoil.

Figure 3A:
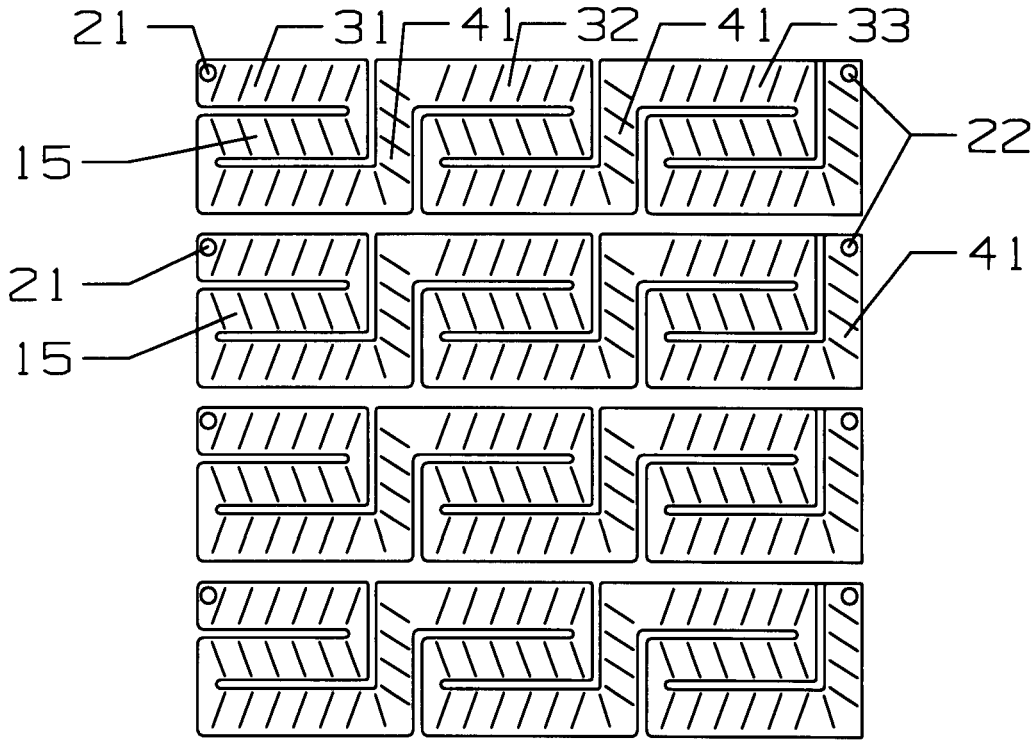
FIG. 3*a* shows a detailed view of a triple 3-pass near wall serpentine cooling circuit of the present invention.

FIG. 3*a* shows a detailed view of a first embodiment of the near wall mini serpentine flow cooling channel used in the blade of FIG. 2. FIG. 3 shows four of the mini serpentine flow channels 15 each having a cooling air feed hole 21 that is connected to a cooling supply cavity 12 and a cooling air return hole 22 that is connected to a cooling air discharge cavity 13. As seen in FIG. 3*a*, the mini serpentine flow channel includes a triple 3-pass near wall mini serpentine flow channel with a first 3-pass serpentine flow channel 31 having three legs extending in the airfoil chord wise direction, a second 3-pass serpentine flow channel 32 and a third 3-pass serpentine flow channel 33 each connected by a airfoil spanwise channel 41. The last spanwise channel 41 connects the third 3-pass serpentine flow channel 33 to the cooling air return hole 22.

Figure 3B:
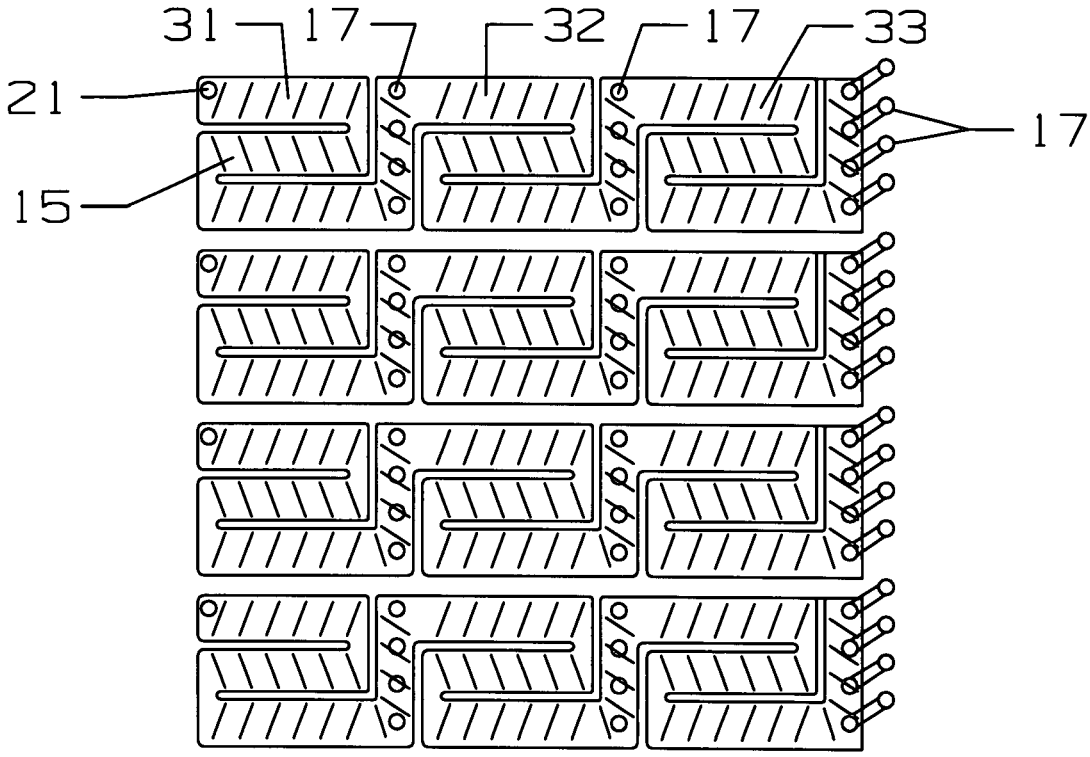
FIG. 3*b* shows a detailed view of a second embodiment of the present invention with rows of film cooling holes.

The second embodiment is shown in FIG. 3*b* and is similar to the first embodiment of FIG. 3*a* in which three 3-pass serpentine flow channels 31 through 33 are arranged along the airfoil wall in the chord wise direction with a cooling air feed hole 21 connected to a cooling supply cavity 12. The FIG. 3*b* embodiment eliminates the cooling air return holes 22 and includes a row of film cooling holes 17 in each of the spanwise channels 41. On the suction side wall, the film cooling holes would be suction side film cooling holes 16 to discharge onto the suction side wall.

In the two embodiments of FIGS. 3*a* and 3*b*, cooling air is supplied through the cooling supply cavity 12, metered through the cooling feed hole 21 and into the axial mini serpentine flow module 15. Cooling air is then passed through the chord wise serpentine flow channel and then discharged through the return hole 22 into the spent cooling air collector cavity 13 within the airfoil mid-chord section or out the row of film cooling holes 16 or 17 on the pressure side or the suction side walls if used. Multiple film cooling holes can be used to discharge cooling air from the collector cavity 13 or from the mini serpentine cooling passage to provide film cooling for the airfoil external surface.

Figure 4:
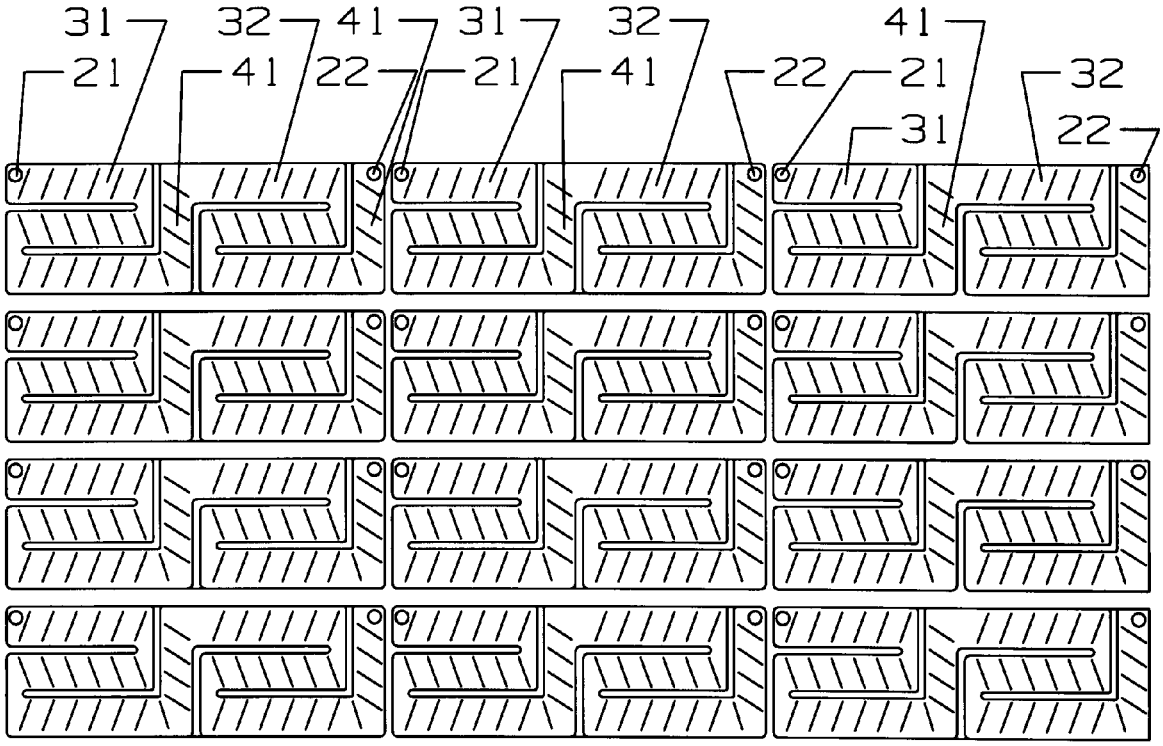
FIG. 4 shows a third embodiment of the near wall mini serpentine flow cooling channel of the present invention.

A third embodiment of the present invention is shown in FIG. 4 in which the cooling circuit include a two 3-pass serpentine flow channels 31 and 32 instead of three 3-pass channels as shown in FIGS. 3*a* and 3*b*. Each mini serpentine flow channel includes a first 3-pass channel 31 and a second 3-pass channel 32 connected by a spanwise channel 41. A feed hole 21 supplies cooling air to the first 3-pass channel and a discharge hole 22 discharges cooling air from the second 3-pass channel 32. As in the FIG. 3*b* embodiment, the discharge holes 22 can be replaced with a row of film cooling holes to discharge the cooling air onto the external surface of the airfoil.

In each of the near wall mini serpentine flow channels of the above embodiments, the cooling air flow through the individual module can be regulated according to the airfoil gas side pressure distribution in both the chord wise and the span wise directions to control the airfoil main body metal temperature. Also, each individual module can be designed based on the airfoil local external heat load to achieve a desired local metal temperature. Varying the size of the supply hole 21 or the discharge hole 22 can accomplish this adjustment. The mini serpentine module can be designed as a 5-pass counter and parallel flow serpentine network or a triple-pass counter and parallel flow serpentine network. Also, the individual small modules can be constructed in a multiple array along the airfoil main body wall in an inline or staggered array. For example, it can be a triple 3-pass mini serpentine flow circuit as seen in FIGS. 3*a* and 3*b*, or a double 3-pass mini serpentine flow circuit, or a single 3-pass mini serpentine flow circuit depending on the airfoil local heat load or required design metal temperatures. Also, the mini serpentine passages can be any arrangement of 2, 3, 4, or 5 pass chordwise channels in series such. For example, the chordwise extending mini serpentine circuits can be 2 by 5-pass channels, 3 by 3-pass channels, 4 by 3-pass channels, or any other combination. With the near wall mini serpentine cooling modules of the present invention, a maximum usage of cooling air for a given airfoil inlet gas temperature and pressure profile can be achieved. Also, the multi-pass of cooling air in the serpentine channels yields a higher internal convection cooling effectiveness than does the single pas radial flow channel used in the prior art near wall cooling circuit.

I claim the following:

1. A turbine airfoil comprising:

a leading edge and a trailing edge;

an airfoil wall extending between the leading edge and the trailing edge;

a cooling air supply cavity partially formed by the airfoil wall;

a cooling air discharge cavity partially formed by the airfoil wall;

a near wall mini serpentine flow cooling module located within the airfoil wall;

a cooling air feed hole connecting the cooling air supply cavity to a first leg of the mini serpentine flow cooling module; and, a cooling air discharge hole connecting the cooling air discharge cavity to a last leg of the mini serpentine flow cooling module.

2. The turbine airfoil of claim 1, and further comprising:

the mini serpentine flow cooling module comprises a plurality of chordwise extending serpentine flow channels connected together by a spanwise extending channel.

3. The turbine airfoil of claim 2, and further comprising:

the chordwise extending serpentine flow channels are 3-pass serpentine flow channels.

4. The turbine airfoil of claim 2, and further comprising:

the module comprises three serpentine flow channels connected together by a spanwise channel.

5. The turbine airfoil of claim 2, and further comprising:

at least one of the spanwise channels includes a row of film cooling holes to discharge film cooling air onto the airfoil external surface.

6. The turbine airfoil of claim 1, and further comprising:

a second cooling air discharge cavity located adjacent to the first cooling air discharge cavity;

a second cooling air discharge hole connecting the mini serpentine flow cooling module to the second cooling air discharge cavity.

7. The turbine airfoil of claim 1, and further comprising:

a film cooling hole connected to the cooling air discharge cavity to discharge film cooling air onto the external airfoil surface.

8. The turbine airfoil of claim 2, and further comprising:

the first mini serpentine module is located on the pressure side wall of the airfoil; and, a second mini serpentine module located on the suction side wall of the airfoil and having a cooling air feed hole connected to the cooling air supply cavity and a cooling air discharge hole connected to the cooling air discharge cavity.

9. The turbine airfoil of claim 8, and further comprising:

a plurality of mini serpentine modules extending along the airfoil wall in the chordwise direction of the airfoil, each mini serpentine module connected to a separate cooling air supply cavity and a cooling air discharge cavity.

10. A stator vane for use in a gas turbine engine, the vane comprising:

a leading edge and a trailing edge;

a pressure side wall and a suction side wall extending between the leading edge and the trailing edge;

a leading edge cooling air supply cavity and a first cooling air discharge cavity located aft of the leading edge cooling air supply cavity;

a first pressure side mini serpentine cooling module located on the pressure side wall;

a cooling air feed hole connecting the first pressure side mini serpentine cooling module to the leading edge cooling air supply cavity;

a cooling air discharge hole connecting the first pressure side mini serpentine cooling module to the first cooling air discharge cavity;

a first suction side mini serpentine cooling module located on the suction side wall;

a cooling air feed hole connecting the first suction side mini serpentine cooling module to the leading edge cooling air supply cavity;

a cooling air discharge hole connecting the first suction side mini serpentine cooling module to the first cooling air discharge cavity; and, the mini serpentine cooling modules each having a plurality of serpentine flow channels extending in the airfoil chordwise direction and connected together by a spanwise extending channel.

11. The stator vane of claim 10, and further comprising:

a second cooling air discharge cavity located between the leading edge supply cavity and the first cooling air discharge cavity; and, a second cooling air discharge hole connecting the first suction side mini serpentine cooling module to the second cooling air discharge cavity.

12. The stator vane of claim 10, and further comprising:

a pressure side film cooling hole connecting the cooling air discharge cavity to the external surface of the; and, a suction side film cooling hole connecting the cooling air discharge cavity to the external surface of the airfoil.

13. The stator vane of claim 10, and further comprising:

a showerhead arrangement of film cooling holes connecting the leading edge cooling supply cavity.

14. The stator vane of claim 10, and further comprising:

the suction side module including a row of film cooling holes in at least one of the spanwise extending channels to discharge film cooling air onto the external suction side airfoil wall.

15. The stator vane of claim 10, and further comprising:

a mid-chord cooling air supply cavity and a mid-chord cooling air discharge cavity;

a second pressure side mini serpentine cooling module located on the pressure side wall;

a cooling air feed hole connecting the second pressure side mini serpentine cooling module to the mid-chord cooling air supply cavity;

a cooling air discharge hole connecting the second pressure side mini serpentine cooling module to the mid-chord cooling air discharge cavity;

a second suction side mini serpentine cooling module located on the suction side wall;

a cooling air feed hole connecting the second suction side mini serpentine cooling module to the mid-chord cooling air supply cavity; and, a cooling air discharge hole connecting the second suction side mini serpentine cooling module to the mid-chord cooling air discharge cavity.

16. The stator vane of claim 15, and further comprising:

a trailing edge cooling air supply cavity and a trailing edge cooling air discharge cavity;

a third pressure side mini serpentine cooling module located on the pressure side wall;

a cooling air feed hole connecting the third pressure side mini serpentine cooling module to the trailing edge cooling air supply cavity;

a cooling air discharge hole connecting the third pressure side mini serpentine cooling module to the trailing edge cooling air discharge cavity;

a third suction side mini serpentine cooling module located on the suction side wall;

a cooling air feed hole connecting the third suction side mini serpentine cooling module to the trailing edge cooling air supply cavity; and, a cooling air discharge hole connecting the second suction side mini serpentine cooling module to the trailing edge cooling air discharge cavity.

17. The turbine airfoil of claim 2, and further comprising:

the chordwise extending serpentine flow channels are 5-pass serpentine flow channels.

* * * * *